US008276685B2

(12) United States Patent
Hozumi et al.

(10) Patent No.: US 8,276,685 B2
(45) Date of Patent: Oct. 2, 2012

(54) ELECTRICAL POWER TOOL

(75) Inventors: Akihiro Hozumi, Takatsuki (JP); Koji Omori, Kusatsu (JP); Hiroyuki Miyaura, Ibaraki (JP); Yoshiyuki Baba, Hikone (JP); Junichi Nishikimi, Anjo (JP); Akira Tomonaga, Anjo (JP)

(73) Assignees: OMRON Corporation, Kyoto (JP); Makita Corporation, Aichi (JP)

( * ) Notice: Subject to any disclaimer, the term of this patent is extended or adjusted under 35 U.S.C. 154(b) by 0 days.

(21) Appl. No.: 12/643,446

(22) Filed: Dec. 21, 2009

(65) Prior Publication Data

US 2010/0163265 A1 Jul. 1, 2010

(30) Foreign Application Priority Data

Dec. 26, 2008 (JP) ..... 2008-333662

(51) Int. Cl.
*E21B 3/00* (2006.01)

(52) U.S. Cl. ..... 173/217; 173/39; 173/213; 173/216; 173/170

(58) Field of Classification Search ..... 173/47, 173/48, 170, 213, 216, 217
See application file for complete search history.

(56) References Cited

U.S. PATENT DOCUMENTS 3,430,707 A * 3/1969 Rees ..... 173/48
3,511,947 A * 5/1970 Eikermann et al. ..... 310/68 A
4,748,353 A * 5/1988 Klingenstein et al. ..... 310/50
4,772,765 A * 9/1988 Markle et al. ..... 200/1 V
4,978,877 A * 12/1990 Quirijnen ..... 310/239
5,089,729 A * 2/1992 Moores, Jr. ..... 310/50
5,225,727 A * 7/1993 Melrose et al. ..... 310/50
5,489,484 A 2/1996 Wheeler et al.
6,467,556 B2 * 10/2002 Alsruhe ..... 173/217
7,487,844 B2 * 2/2009 DeCicco et al. ..... 173/2
7,649,337 B2 * 1/2010 Uehlein-Proctor et al. .. 320/112
7,673,701 B2 * 3/2010 Tanaka et al. ..... 173/4
7,703,330 B2 * 4/2010 Miyazaki et al. ..... 73/761
7,814,816 B2 * 10/2010 Alberti et al. ..... 81/57.13

(Continued)

FOREIGN PATENT DOCUMENTS

CN 101134307 A 3/2008

(Continued)

OTHER PUBLICATIONS

Office Action in Japanese Patent Application No. 2008-333662, Dated Feb. 4, 2011 (7 Pages With English Translation).

(Continued)

*Primary Examiner* — Sameh H. Tawfik
*Assistant Examiner* — Eyamindae Jallow
(74) *Attorney, Agent, or Firm* — Osha Liang LLP

(57) ABSTRACT

In view of the above problem, the present invention is to provide an electrical power tool which enables a user to intuitively grasp a rotation direction and a rotation speed of a tip tool. The electrical power tool 1 comprises a chuck 2 provided at a tip of a tool body 3, and rotatable with a tip tool held, and an operation switch 7 having operation protrusions 6 exposed to both side surfaces of a tool body 3 so as to be able to operate, respectively bilaterally symmetrically protruded with a rotation axis of the chuck 2 therebetween, coaxially rotatable with the chuck 2, and urged so as to be self-restored to a neutral position. The chuck 2 is rotated in a direction according to a rotation direction of the switch 7 at a speed according to a rotation angle from the neutral position of the operation switch 7.

4 Claims, 8 Drawing Sheets

U.S. PATENT DOCUMENTS

2010/0126745 A1* 5/2010 Zhu ..... 173/48

FOREIGN PATENT DOCUMENTS

| | | | |
|---|---|---|---|
| DE | 4128651 | A1 | 3/1993 |
| EP | 0278649 | A2 | 8/1988 |
| JP | 61-76285 | A | 4/1986 |
| JP | 8-508605 | T | 9/1996 |
| JP | 2002-154073 | A | 5/2002 |
| JP | 3768400 | | 2/2006 |
| JP | 2006-218560 | | 8/2006 |

OTHER PUBLICATIONS

English Patent Abstract of JP 8-508605 from esp@cenet, Published Sep. 10, 1996 (1 Page).

Patent Abstracts of Japan for Japanese Publication No. 2002-154073, Publication date May 28, 2002 (1 page) (Corresponds to JP3768400).

Patent Abstracts of Japan for Japanese Publication No. 2006-218560, Publication date Aug. 24, 2006 (1 page).

Office Action issued in Chinese Application No. 200910266329., Dated Jun. 21, 2011 (10 Pages with English Translation).

English Patent Abstract of CN 101134307 from esp@cenet, Published Mar. 5, 2008 (1 Page).

Extended European Search Report Issued in European Application No. 09180405.4, Dated Jul. 18, 2012 (5 Pages).

English Patent Abstract of DE 4128651, Publication Date: Mar. 4, 1993 (1 Page).

* cited by examiner

ELECTRICAL POWER TOOL

TECHNICAL FIELD

The present invention relates to an electrical power tool.

BACKGROUND ART

As described in Patent Document 1, a conventional electrical power tool has a tool body coaxially extending with a rotation axis of a tip tool, a grip extending downward from the tool body, and a trigger provided on top of the grip. By operating the trigger so that it is pulled in toward the grip, the tip tool is rotated at a speed according to the degree to which the trigger is pulled in.

Further, in the conventional electrical power tool, a switch for switching a rotation direction is provided. Patent Document 2 discloses the invention in which a relationship between the degree to which a trigger is pulled in and a rotation speed of a tip tool is varied depending on the rotation direction.

In the conventional electrical power tool, a user intuitively grasps the degree to which the trigger is pulled in. However, it is difficult to recognize a slight difference in the degree to which the trigger is pulled in. Thus, there was a problem that it was possible to perform only rough speed control.

In addition, in an electrical power tool having the trigger, the tool body and the grip are bent and fixed, so that the electrical power tool cannot enter a work space if it is small.

Patent Document 1: JP2006-218560A

Patent Document 2: U.S. Pat. No. 3,768,400

DISCLOSURE OF INVENTION

Problem to be Solved by Invention

In view of the above problem, the present invention is to provide an electrical power tool that a user can intuitively grasp a rotation speed, preferably a rotation direction, of a tip tool, and more preferably to provide an electrical power tool whose shape can be changed according to the work space.

Means of Solving the Problem

In order to solve the above problem, an electrical power tool comprises:

a chuck provided at a tip of a tool body, and rotatable with a tip tool held; and an operation switch exposed to a side surface of the tool body so as to be able to operate, and rotatably provided around an axis parallel to a rotation axis of the chuck, wherein the chuck is rotated at a speed according to a rotation angle of the operation switch.

With this construction, since the operation switch is rotated with respect to the tool body, the user can intuitively grasp the rotation angle from a neutral position of the operation switch, from a relative angle between the tool body and the operation switch. Further, since the tip tool is rotated coaxially with the operation switch according to the rotation angle of the operation switch, the user can intuitively grasp a rotation speed of the tip tool, and perform fine speed control.

In the electrical power tool of the present invention, the chuck may be rotated in a direction according to a rotation direction of the operation switch.

With this construction, since it is possible to switch the rotation direction of the tip tool according to the rotation direction of the operation switch, an extra operation for switching the rotation direction is not required, and it is possible to perform work that requires frequent switching of the rotation direction continuously and effectively.

In the electrical power tool of the present invention, the operation switch may be urged so as to be self-restored to a neutral position at which rotation of the chuck is stopped.

With this construction, it is possible to stop the electrical power tool only by releasing the operation switch. Further, the user can grasp the rotation speed of the tip tool also by a reaction force due to the urging force of the operation switch.

In the electrical power tool of the present invention, the operation switch may have operation protrusions respectively protruded from both side surfaces of the tool body, and bilaterally symmetrically formed with a rotation axis of the operation switch therebetween, preferably with the rotation axis therebetween at an angle of 180°.

With this construction, it is possible to use the electrical power tool by either a right or left hand. Further, since it is possible to place a thumb and another finger on the operation protrusions on both sides, grasp the operation switch so as to pinch it, and rotate the operation switch like dialing, the rotation angle of the operation switch can be easily grasped.

The electrical power tool of the present invention may have a lock mechanism capable of preventing rotation of the operation switch at a neutral position by engaging therewith.

With this construction, it does not happen that the operation switch is rotated due to a contact of the operation protrusions with a floor or surrounding objects, and an accident or wasteful discharge of a battery due to unintentional movement can be prevented.

In the electrical power tool of the present invention, a grip gripped by a user is provided at a rear end of the tool body, and the operation switch may be provided in the vicinity of the grip.

With this construction, since the user can extend fingers of the hand that grasps the grip toward the operation switch and rotate the operation switch, it is possible to operate the electrical power tool even with one hand.

In the electrical power tool of the present invention, the grip may be rotatably attached so as to be able to both extend roughly parallel to the rotation axis of the operation switch, and extend at a slant or a right angle with respect to the rotation axis of the operation switch, from the rear end of the tool body.

With this construction, by placing the grip at a slant or at a right angle with respect to the rotation axis of the operation switch, it can be used as an electrical power tool of a gun-grip type, and, by placing the grip parallel to the rotation axis of the operation switch, it can be used also as an electrical power tool of a pen-grip type which can be inserted into a work space having a narrow width.

Effect of Invention

According to the present invention, since the operation switch, which is rotated around the axis parallel to the rotation axis of the tip tool, and determines the rotation direction and the rotation speed of the tip tool according to the rotation direction and the rotation angle of the operation switch, is provided, the user can intuitively grasp the operation amount of the operation switch, and finely control the speed of the tip tool. In addition, the grip is rotatable with respect to the tool body, whereby the electrical power tool can be used in various work spaces by changing the shape of the electrical power tool.

BEST MODE FOR CARRYING OUT THE INVENTION

Figure 1:
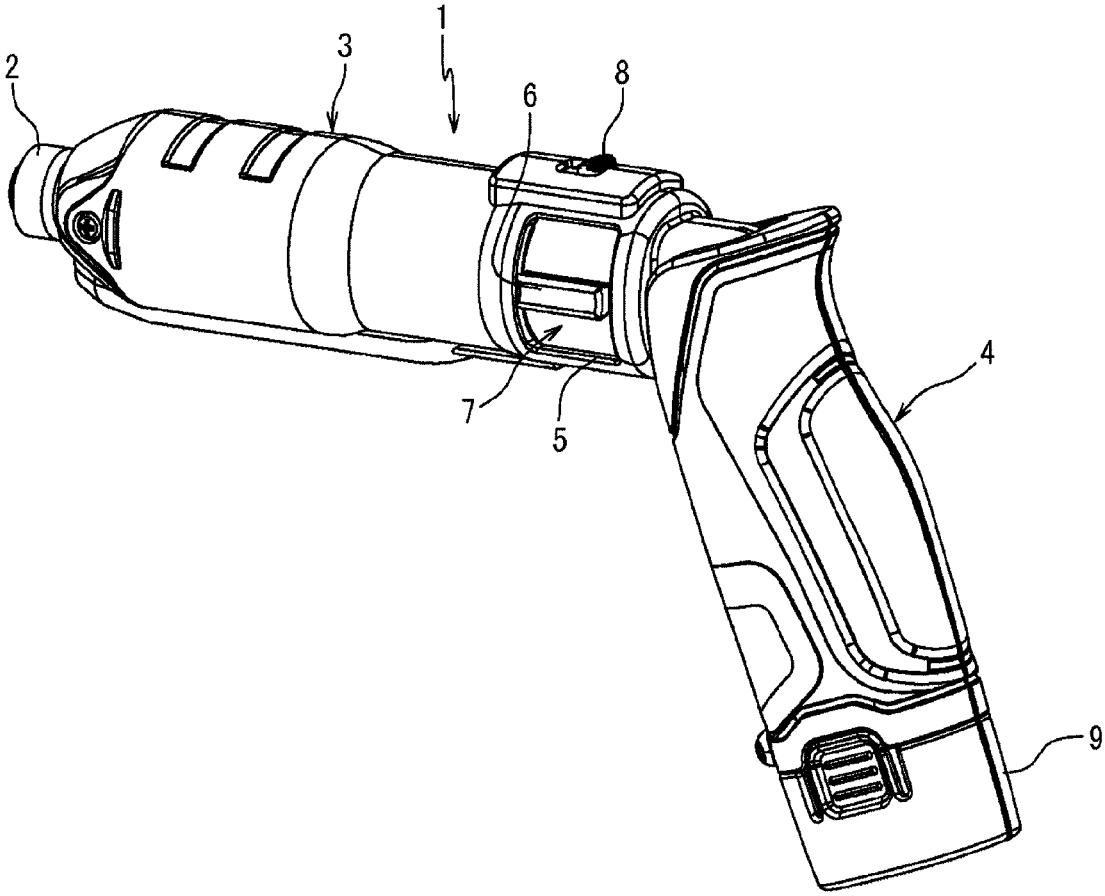
FIG. 1 is a perspective view of an electrical power tool of one embodiment of the present invention.
Figure 2:
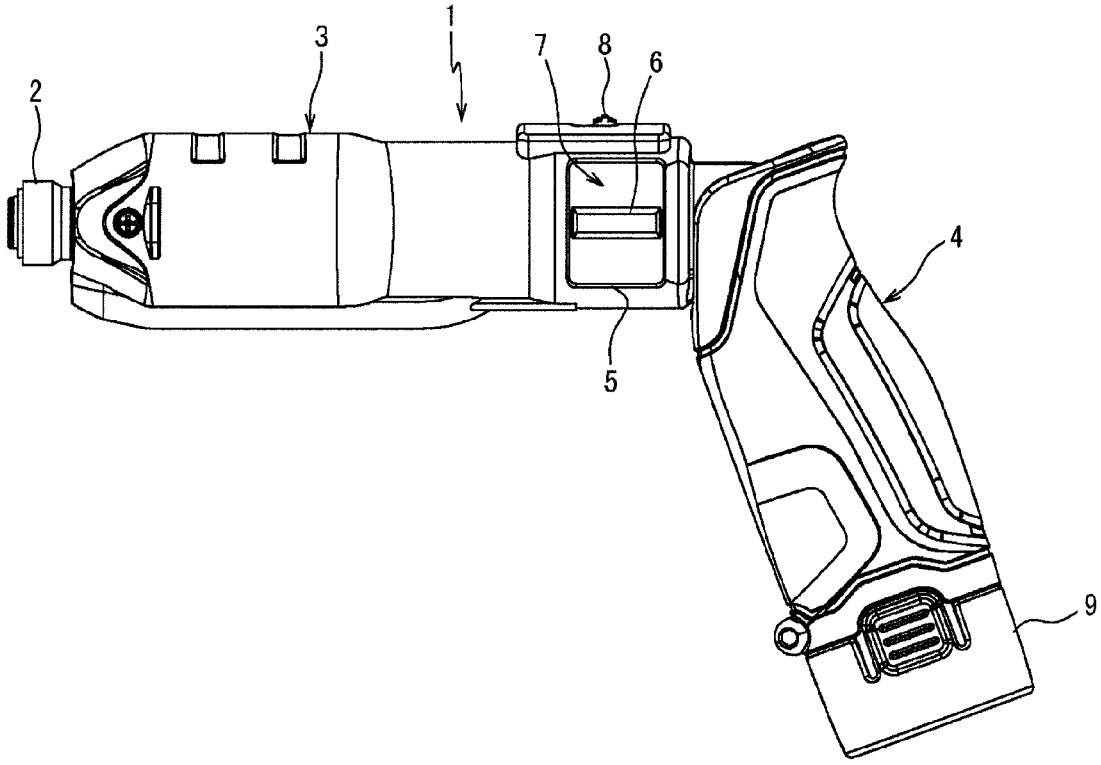
FIG. 2 is a left side view of the electrical power tool of FIG. 1.
Figure 3:
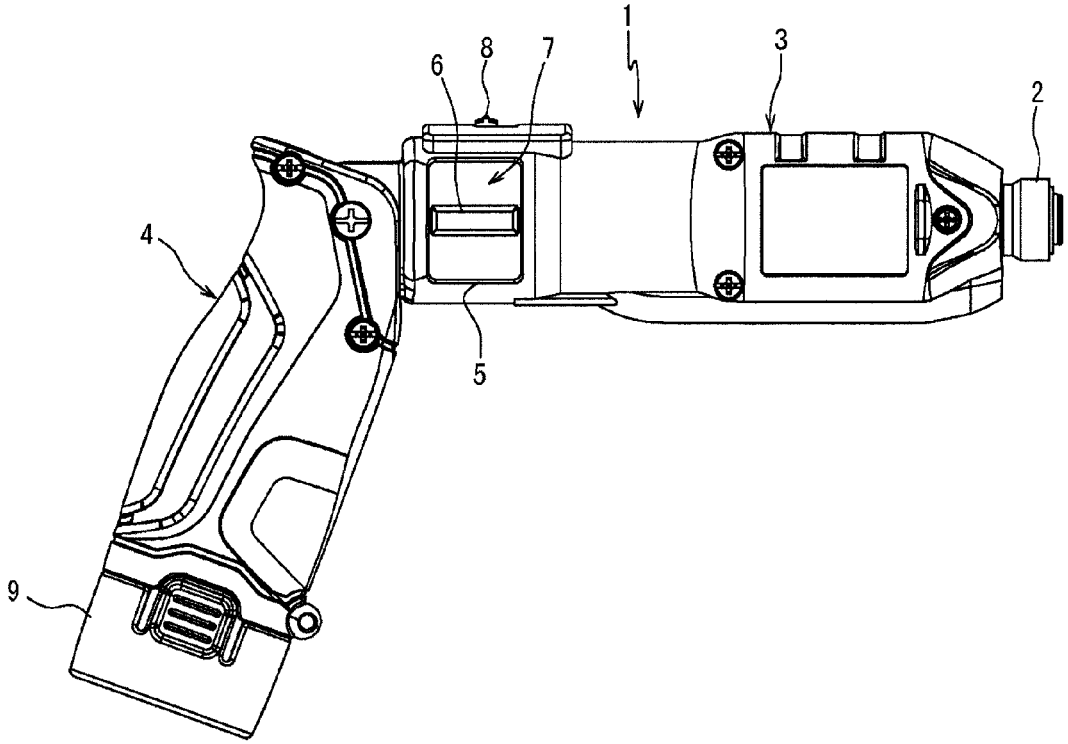
FIG. 3 is a right side view of the electrical power tool of FIG. 1.

The present invention will hereinafter be described with reference to the drawings. FIGS. 1 to 3 show an electrical power tool 1 of one embodiment of the present invention. The electrical power tool 1 has a chuck 2 which is rotatable with a tip tool such as a drill and a driver gripped, a roughly cylindrical shaped tool body 3, which is roughly coaxial with a rotation axis of the chuck 2, and a grip 4 for a user to grip, which extends downward and obliquely backward from a rear end of the tool body 3.

The tool body 3 has an operation switch 7 having two operation protrusions 6 respectively protruded from switch openings provided on both sides in the vicinity of the rear end, and a lock switch 8 provided so as to be positioned above the operation switch 7. The operation protrusions 6 are protrusions, each of which extends parallel to the rotation axis of the chuck 2, and which are bilaterally symmetrically formed with the rotation axis of the chuck 2 therebetween at an angle of 180°. Further, the tool body 3 has a motor (not shown) for rotating the chuck 2 built therein. The grip 4 detachably holds a battery 9, and is rotatably attached with respect to the tool body 3.

Figure 4:
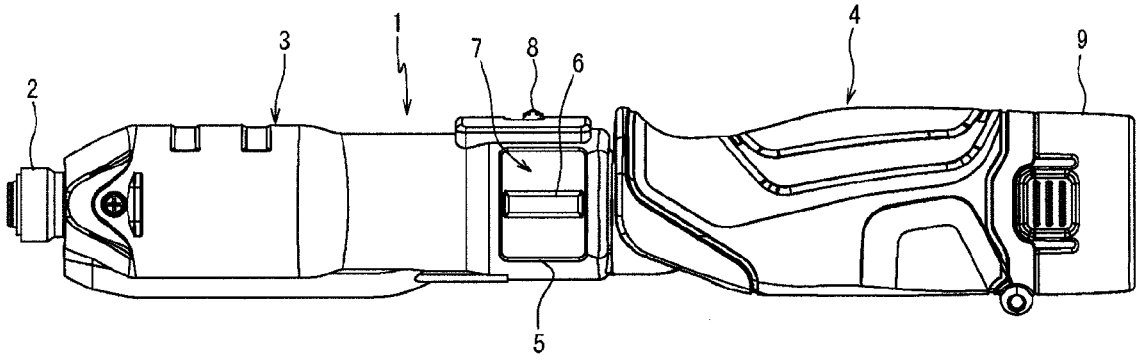
FIG. 4 is a left side view in a state in which a grip of the electrical power tool of FIG. 1 is rotated.

As shown in FIG. 4, the grip 4 can also deform the whole electrical power tool 1 in a roughly rod shape by being aligned in a roughly straight line with the tool body 3. This enables the electrical power tool 1 to be inserted into a narrow work space, where work can be performed.

Figure 5:
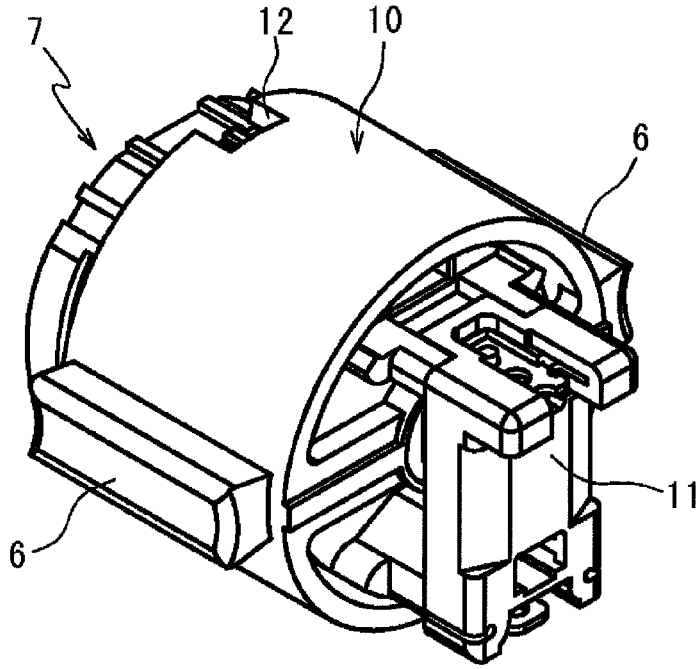
FIG. 5 is a perspective view of an operation switch of the electrical power tool of FIG. 1.

The operation switch 7 taken out from the tool body 3 is shown in FIG. 5. The operation switch 7 consists of a roughly cylindrical shaped cylinder 10 formed with the operation protrusions 6, and a switch body 11 located inside the cylinder 10 and fixed with respect to the tool body 3. The cylinder 10 is rotatable around the switch body 11, and is incorporated into the tool body 3 so that a rotation axis of the cylinder 10 is coaxial with the rotation axis of the chuck 2 and the tip tool held by the chuck 2. Further, the cylinder 10 has a notch 12 formed in one end of a cylinder wall.

Figure 6:
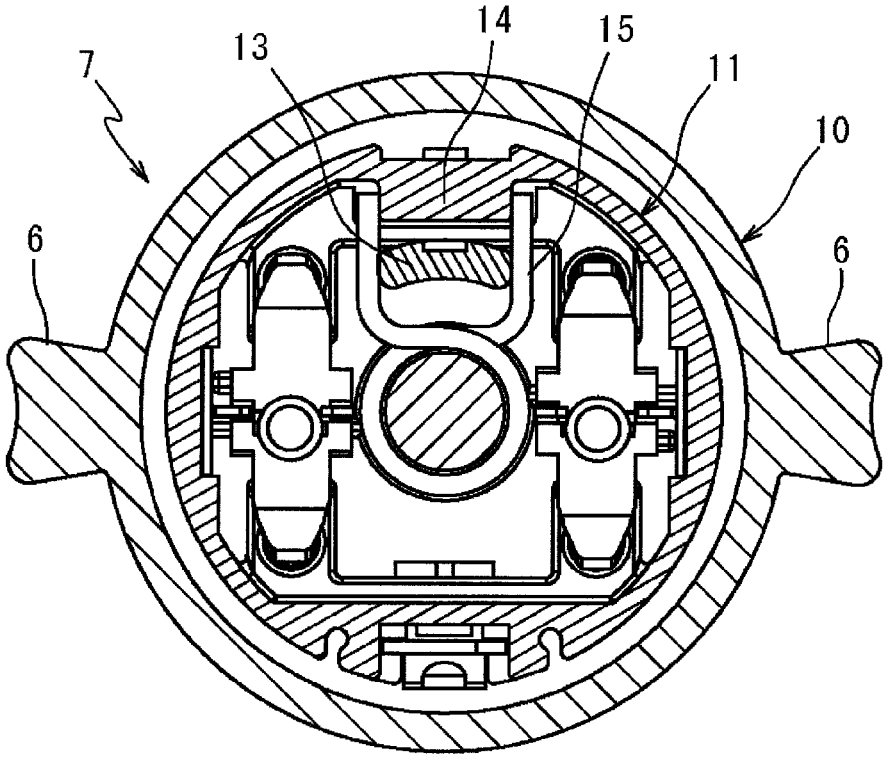
FIG. 6 is a cross sectional view of the operation switch of FIG. 5.

As shown in FIG. 6, the operation switch 7 has an action portion 13, which is integrally rotated with the cylinder 10 inside the switch body 11. The switch body 11 is formed in a roughly cylindrical shape, and has an engagement portion 14 that inwardly protrudes. Further, the operation switch 7 has an urging spring 15 whose central portion is wound around a rotation shaft of the cylinder 10, and whose both end portions pinch the action portion 13 and the engagement portion 14.

Figure 7:
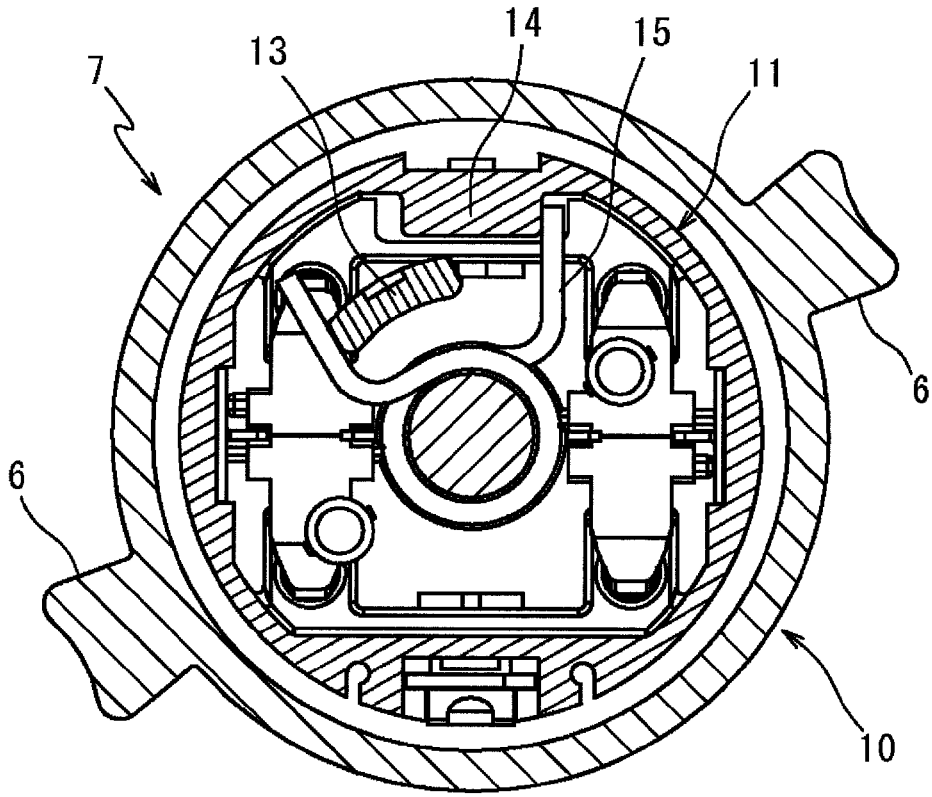
FIG. 7 is a cross sectional view of the operation switch of FIG. 5 when rotated.

As shown in FIG. 7, if the cylinder 10 is rotated, the action portion 13 and the engagement portion 14 are separated to expand the both end portions of the urging spring 15 against its urging force. When a user releases the user's hand from the cylinder 10, the urging spring 15 rotates the action portion 13 by its urging force so that the action portion 13 is radially aligned with the engagement portion 14, and then allow the cylinder 10 to be self-restored to a neutral position where the operation protrusions 6 become horizontal.

The operation switch 7 has an input terminal connected to an electrode of a battery 9 attached to the grip 4, an output terminal connected to an input terminal of the motor built in the tool body 3, and a speed controlling circuit built therein, which can invert the polarity of the output terminal and vary the output voltage while controlling a current application time ratio. The speed controlling circuit outputs no voltage to the output terminal when the cylinder 10 is at the neutral position, so as to stop rotation of the chuck 2.

Figure 8:
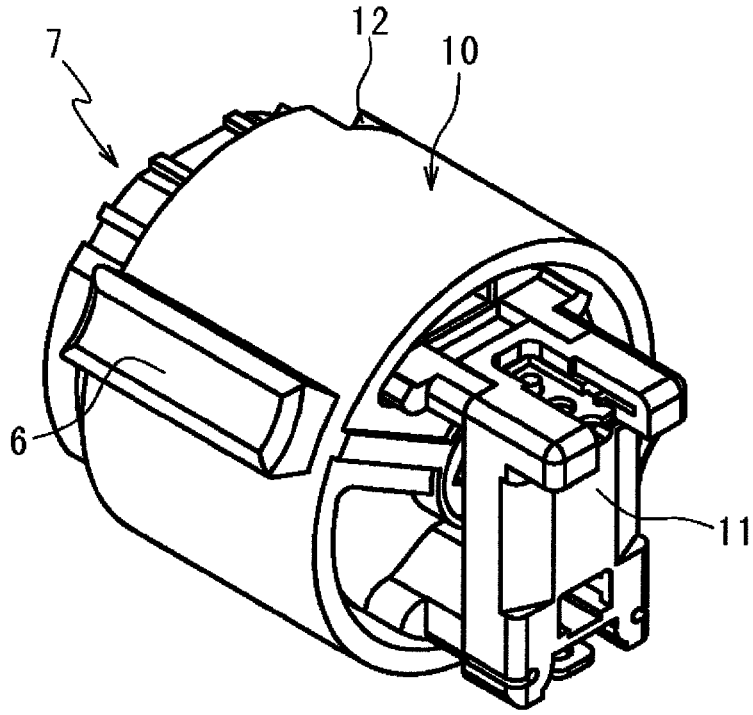
FIG. 8 is a perspective view of the operation switch of FIG. 5 when rotated right-handed.

As shown in FIG. 8, in the electrical power tool 1, if the cylinder 10 is rotated right-handed from the neutral position, seen from the grip 4 side, the speed controlling circuit of the operation switch 7 outputs a voltage according to a rotation angle of the cylinder 10 with the polarity that rotates the chuck 2 right-handed. Thereby, the chuck 2 is rotated at a speed according to the rotation angle of the cylinder 10 of the operation switch 7. Incidentally, in the present application, when referring to the rotation speed of the chuck 2 (tip tool), it indicates an unloaded rotation speed, and does not necessarily coincide with a rotation speed when loaded.

Figure 9:
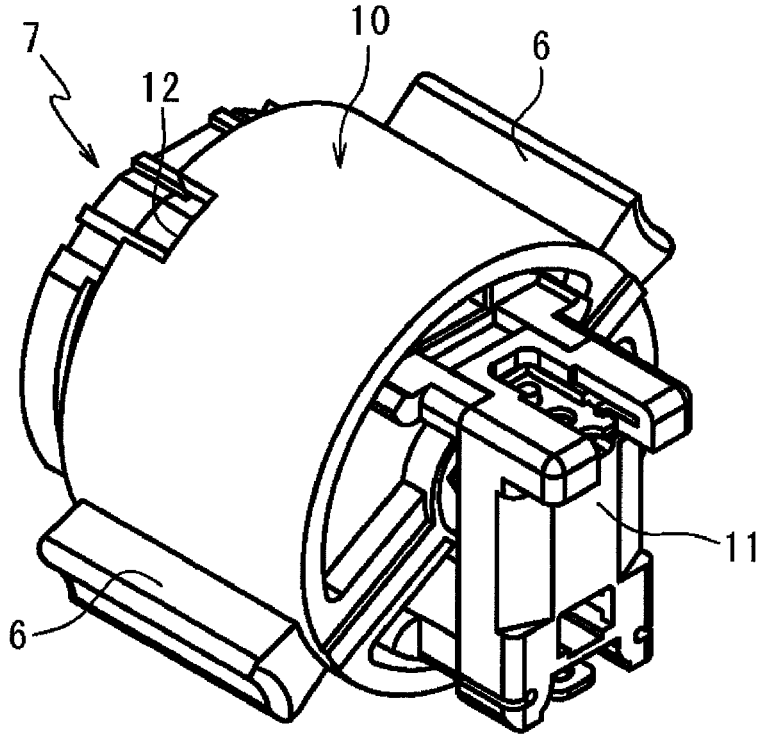
FIG. 9 is a perspective view of the operation switch of FIG. 5 when rotated left-handed.

Further, as shown in FIG. 9, if the cylinder 10 is rotated left-handed from the neutral position, the speed controlling circuit of the operation switch 7 outputs a voltage to rotate the chuck 2 left-handed according to the rotation angle of the cylinder 10.

Gripping the grip 4 of the electrical power tool 1, the user can extend the user's thumb and put it on the operation protrusion 6 provided in the vicinity of the grip 4, and can also extend the user's index finger and put it on the operation protrusion 6 on the opposite side, and further can hold the operation protrusions 6 in a manner so as to pinch the operation protrusions 6 on both sides with the thumb and the index finger. That is, the user can rotate the cylinder 10 of the operation switch 7 while gripping the grip 4. Further, this is the same both when the electrical power tool 1 is gripped by the right hand and when it is gripped by the left hand and thus it is possible to handle the electrical power tool 1 by either the right or left hand.

The user can intuitively grasp the rotation angle of the operation switch 7 based on a direction of the grip 4 that the user grips. That is, the user can easily grasp the rotation speed of the chuck 2 and finely control its rotation speed. In addition, although a rotation axis of the operation switch 7 is coaxial with the rotation axis of the chuck 2 in the electrical power tool 1 of the present embodiment, even if the rotation axis of the operation switch 7 is not coaxial with the rotation axis of the chuck 2, there is almost no problem in operability as long as the rotation axis of the operation switch 7 is roughly parallel to the rotation axis of the chuck 2.

Since a rotation direction of the chuck 2 coincides with a rotation direction of the operation switch 7, no switching operation for switching the rotation direction is required, so that it is possible to continuously perform the work. Further, since the operation switch 7 is rotated in a direction in which the user desires to rotate the tip tool, there never occurs a failure that the user rotates the tip tool in the opposite direction by mistake.

Figure 10:
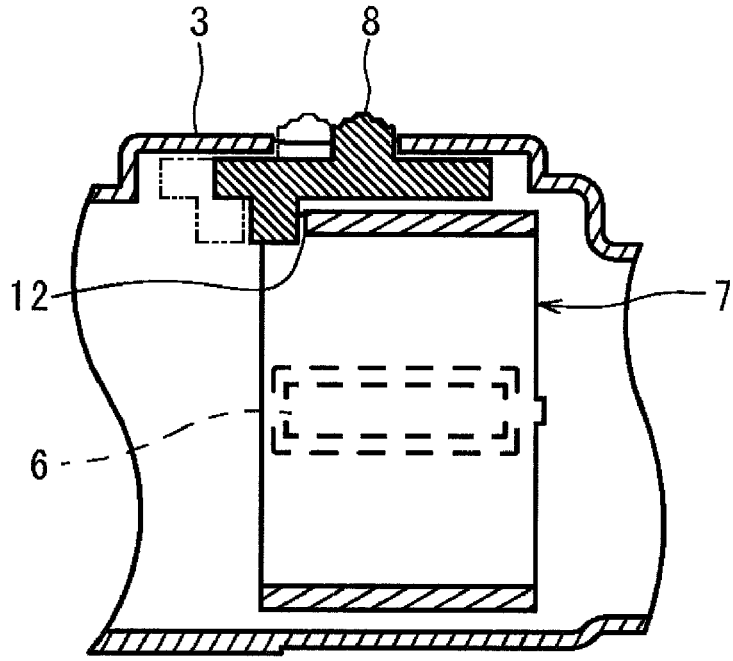
FIG. 10 is an axial cross sectional view of the operation switch of the electrical power tool of FIG. 1.

As shown in FIG. 10, the lock switch 8 is slidably provided parallel to the rotation axis of the chuck 2 and the operation switch 7, and engageable with a notch 12 formed in the cylinder 10 of the operation switch 7. That is, as shown in the figure, the lock switch 8 engages with the notch 12 by sliding to the grip 4 side when the operation switch 7 is at the neutral position, so as to construct a lock mechanism to prevent rotation of the cylinder 10 by engaging therewith.

Preventing the rotation of the operation switch 7 by the engagement of the lock switch 8 therewith enables the chuck 2 to be kept in a stopped state. This makes it possible to prevent injury, damage to articles, and wasteful power consumption due to unintentional rotation of the tip tool caused by a contact of the electrical power tool 1 with a floor or surrounding objects, so that the operation switch 7 is accidentally operated.

Figure 11:
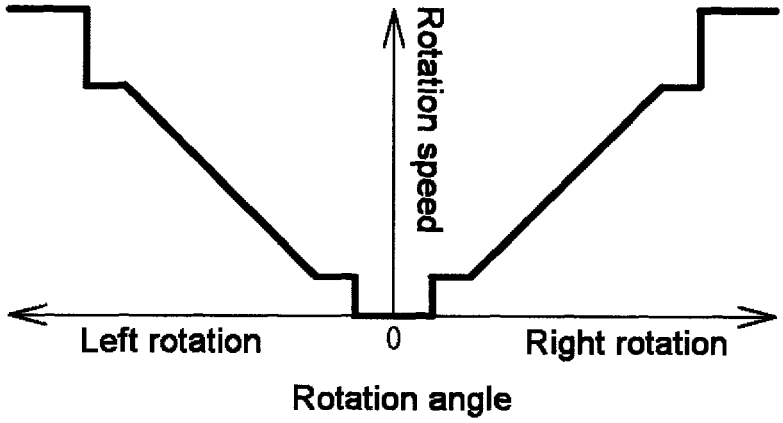
FIG. 11 is a graph showing a relationship between a rotation angle of the operation switch and a rotation speed of a chuck in the electrical power tool of FIG. 1.

FIG. 11 shows a relationship between the rotation angle of the operation switch 7 and the rotation speed of the chuck in the electrical power tool 1. As shown in the figure, when the operation switch is at the neutral position, an electrical path is opened between the input terminal and the output terminal of the speed controlling circuit so as not to output a voltage. When the operation switch 7 is rotated by a few degrees, the input terminal and the output terminal of the speed controlling circuit are connected via a switching element for opening/closing them at a specific time ratio. When the operation switch 7 is further rotated, a variable resistance value of a variable resistor is changed so that the closed time of the switching element becomes longer in proportion to the rotation angle of the operation switch 7. Finally, when the operation switch 7 is rotated by about 30°, the switching element is continuously turned on so that the chuck 2 is rotated at a maximum speed. By this, the user can almost linearly control the rotation number of the tip tool.

Figure 12:
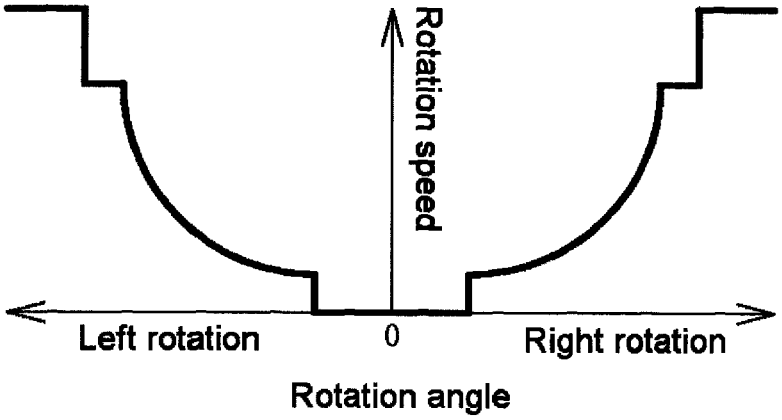
FIG. 12 is a graph showing an alternative idea of the relationship between the rotation angle of the operation switch and the rotation speed of the chuck in FIG. 11.

In addition, when it is desired that the rotation number of the tip tool is more finely adjusted in a low speed region, as shown in FIG. 12, the relationship between the rotation angle of the operation switch 7 and the rotation speed of the chuck 2 may acceleratingly change.

In the above embodiment, although the chuck 2 (and the tip tool held therein) were rotated in the same direction as the rotation direction of the operation switch 7, for example, when operating the electrical power tool 1 by extending only the user's thumb to the operation protrusion, in some cases, the right-handed user sensibly feels it easier to use it when the rotation direction of the operation switch 7 and the rotation direction of the chuck 2 are opposite to each other. That is, in the present invention, the rotation direction of the operation switch 7 and the rotation direction of the chuck 2 may be opposite to each other. Alternatively, the relationship between the rotation direction of the operation switch 7 and the rotation direction of the chuck 2 may be reversed.

Further, in the tip tool such as a grinder bit and a drill, it is hardly required to reverse the rotation direction. Therefore, the chuck 2 may be rotated in the forward direction even if the operation switch 7 is rotated in either direction from the neutral position.

INDUSTRIAL APPLICABILITY

The present invention can be utilized for an electrical power tool for controlling the rotation direction and the rotation speed of the tip tool such as a drill, a driver bit and a grinder.

The invention claimed is:

1. An electrical power tool comprising:

a chuck provided at a tip of a tool body, and rotatable with a tip tool held; and an operation switch exposed to a side surface of the tool body so as to be able to operate, and rotatably provided around an axis parallel to a rotation axis of the chuck, wherein the chuck is stopped when the operation switch is in a predetermined neutral position, wherein the chuck is rotated in a direction according to a rotation direction of the operation switch, wherein a rotation speed of the chuck is continuously changed according to a rotation angle of the operation switch, wherein the operation switch has operation protrusions respectively protruded from both side surfaces of the tool body, and bilaterally symmetrically formed with a rotation axis of the operation switch therebetween, and wherein the operation switch is urged by a spring force due to an urging spring composed of a coiled spring so as to be self-restored to a neutral position at which rotation of the chuck is stopped.

2. The electrical power tool according to claim 1, which has a lock mechanism capable of preventing rotation of the operation switch at a neutral position by engaging therewith.

3. The electrical power tool according to claim 1, wherein a grip gripped by a user is provided at a rear end of the tool body, and the operation switch is provided in the vicinity of the grip.

4. The electric tool of claim 3, wherein the grip is rotatably attached so as to be able to both extend roughly parallel to the rotation axis of the operation switch, and extend at a slant or a right angle with respect to the rotation axis of the operation switch from the rear end of the tool body.

* * * * *